United States Patent [19]

Nagatani

[11] 4,448,124

[45] May 15, 1984

[54] APPARATUS FOR DISCHARGE OF PRINTED SHEETS FROM A CYLINDER TYPE SCREEN PRINTING MACHINE

[75] Inventor: Kazuo Nagatani, Seki, Japan

[73] Assignee: Sakurai Machine Trading Co., Ltd., Tokyo, Japan

[21] Appl. No.: 391,551

[22] Filed: Jun. 24, 1982

[30] Foreign Application Priority Data

Apr. 1, 1982 [JP] Japan ..... 57-47546

[51] Int. Cl.[3] ..... B41L 13/00

[52] U.S. Cl. ..... 101/118; 198/632

[58] Field of Search ..... 101/118, 123, 125, 117; 198/632

[56] References Cited

U.S. PATENT DOCUMENTS

| | | | |
|---|---|---|---|
| 985,872 | 3/1911 | Whiting | 198/632 |
| 997,868 | 7/1911 | Steele | 198/632 |
| 1,020,313 | 3/1912 | Scheuer | 198/632 |
| 1,110,419 | 9/1914 | Carpenter | 198/632 |
| 1,198,701 | 9/1916 | Comer | 198/632 |
| 2,462,447 | 2/1949 | Wellborn | 101/123 |
| 4,182,433 | 1/1980 | Foster | 198/632 |
| 4,193,344 | 3/1980 | Ericsson | 101/123 |
| 4,210,077 | 7/1980 | Lindstrom | 101/123 X |
| 4,245,554 | 1/1981 | Kammann et al. | 101/123 X |

FOREIGN PATENT DOCUMENTS

| | | | |
|---|---|---|---|
| 632022 | 12/1927 | France | 198/632 |
| 372574 | 8/1939 | Italy | 198/632 |

*Primary Examiner*—S. H. Eickholt

*Attorney, Agent, or Firm*—Leydig, Voit, Osann, Mayer & Holt, Ltd.

[57] ABSTRACT

Described is a cylinder type screen printing machine wherein the paper sheet discharge table is divided into a forward belt table of a shorter length and a rear belt table of a longer length. The rear belt table is connected to the forward belt table by a hinge so as to swing down relative to said forward belt table for retreating towards below. When the rear belt table is swung down, a wide space may be provided below the screen.

4 Claims, 7 Drawing Figures

APPARATUS FOR DISCHARGE OF PRINTED SHEETS FROM A CYLINDER TYPE SCREEN PRINTING MACHINE

FIELD OF THE INVENTION

This invention relates to a cylinder-type screen printing machine.

BACKGROUND OF THE INVENTION

FIG. 1 illustrates a typical structure of a prior-art cylinder type screen printing machine. A number of printing paper sheets 101 are stacked in an automatic paper feeder 1 and are fed by a feed tape 2 one by one towards a cylinder 3. The paper sheets thus fed are positioned ahead of the cylinder 3 as illustrated in FIG. 2 (Paper sheet feed means and positioning means are not shown in the drawing for simplicity.)

With rotation of a crank arm 5, a sector gear 7, connected to the crank arm 5 by a connecting rod 6, is moved to and fro as indicated by double arrow marks in FIG. 1. The sector gear 7 meshes with a gear 8 secured to one end face of the cylinder 3 so that the cylinder 3 may be turned reciprocally in the direction of the arrow mark 102 and in the opposite direction. A screen 9 is mounted on top of the cylinder 3 and is moved in the fore and aft directions (in the directions shown by the arrow marks 103, 104) in timing with the revolution of the cylinder 3 in the forward and reverse directions. Means for reciprocating the screen 9 is known per se and therefore is not illustrated in the drawing for simplicity.

In the synchronized reciprocating movements of the cylinder 3 and the screen 9, the cylinder 3 is turned in a direction opposite to the direction indicated by the arrow mark 102 in FIG. 2 to a position such that a pair of paper gripping claws 4 provided to the cylinder 3 can grip the paper sheet 101 in a well-known manner. With the paper sheet thus gripped by the claws 4, the cylinder 3 is turned in the direction shown by the arrow mark 102. Just when the claws 4 pass through a zone below a squeezee 10 which is mounted vertically movably to a printing machine frame, not shown, the squeezee 10 is lowered to press the screen 9 so that the ink placed on the screen 9 is pressed out for printing a design on the surface of the printing paper 101 being delivered on the underside of the screen 9.

When the cylinder 3 is turned in the direction shown by the arrow mark 102, and the claws 4 are opened ahead of a paper guide 11, as indicated by the double-dotted chain line in FIG. 2, the printed paper sheet 101 is fed over the guide 11 onto a paper sheet discharge table 12 mounted on the discharge side of the cylinder. After the cylinder 3 has been turned a predetermined angle in the direction shown by the arrow mark 102 in FIG. 3, it is turned in the direction opposite to the direction shown by the arrow mark 102. In the similar manner, the screen 9 is moved in the forward direction a predetermined distance in the direction shown by the arrow mark 104 and then moved back in the direction shown by the arrow mark 103. As the screen 9 is moved in the direction of the arrow mark 103, the squeezee 10 is raised away from the screen, at the same time that a doctor 13 mounted vertically movably to the printing machine frame is lowered to scrape the ink on the screen 9 by an interlock device which is also known per se and therefore not shown in the drawing for simplicity.

The cylinder 3 then is rotated again in the direction opposite to the arrow mark direction to start the next printing cycle.

In the prior-art device, mentioned above, the operation of cleaning the side of the screen 9 and removing smudges from the surface of the cylinder 3 has been made by having manual access to the underside of the screen 9 from the back side or by insertion of a special tool. However, when the screen 9 is in the position shown in FIGS. 2 or 3, the space 105 between the screen and the paper feed tape 2 and the space 106 between the screen and the discharge table 12 are rather narrow and tend to obstruct the cleaning operation. Hence, the screen 9 must be removed ultimately to effect such cleaning operation.

Hence, when mounted again in the machine after such cleaning operation, the screen 9 has to be positioned accurately with respect to other component parts, while test printing has also to be performed for color matching or reproduction, with resultingly lowered operational efficiency.

Such cleaning operation may be facilitated if the spaces 105, 106 are broader and, to this effect, the paper feed tape 2 or the discharge table 12 are retreated away from the underside of the screen plate 9. However, the paper feed tape 2 can be retreated only with considerable difficulties because of possible collision with other machine components. Hence, it is desired that the discharge table 12 be retreated to facilitate the cleaning of the screen.

OBJECTS OF THE INVENTION

It is an object of the present invention to provide a paper discharge device in a cylinder type screen printing machine whereby cleaning of the underside of the screen and removal of smudges from the cylinder surface may be easily made.

It is another object of the present invention to provide a paper discharge device in a cylinder type screen printing machine whereby the discharge table can be retreated towards below by a simplified rotary structure.

Other objects of the present invention will become more apparent from the following description and the appended claims, many advantages not alluded to in the specification will be readily apparent to those skilled in the art upon execution of the invention.

DETAILED DESCRIPTION OF THE PREFERRED EMBODIMENTS

Figure 1:
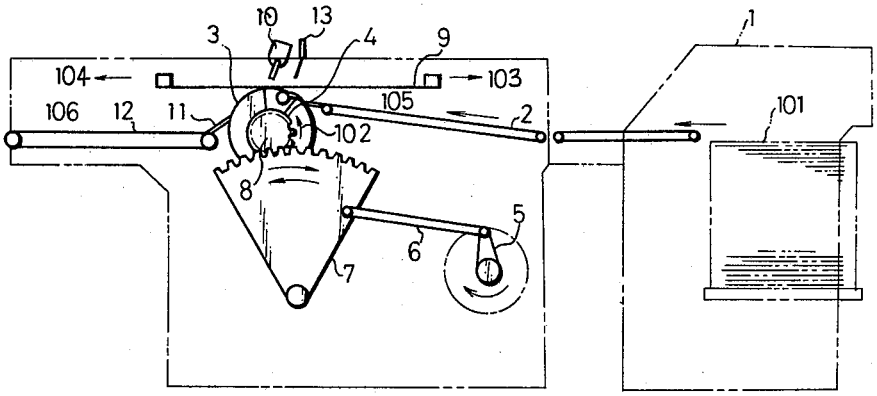
FIG. 1 PRIOR ART
FIG. 1 is a schematic view of the prior-art cylinder-type screen printing machine.
Figure 2:
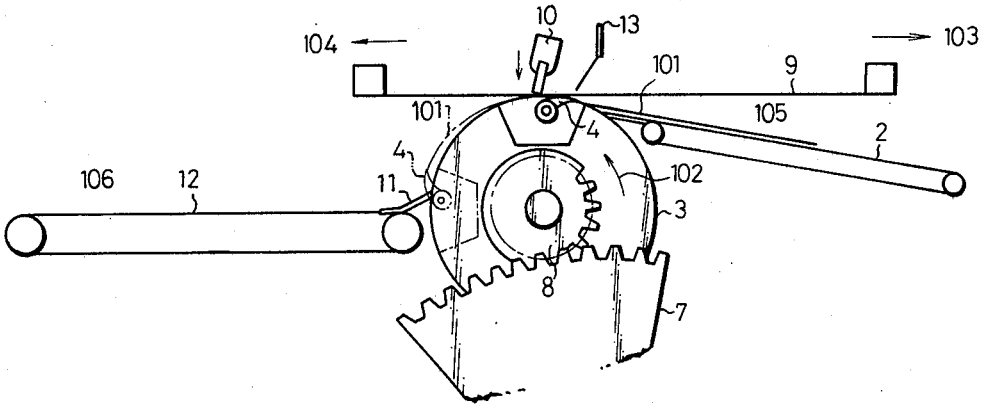
FIG. 2 PRIOR ART
FIG. 2 is a schematic view of the machine shown in FIG. 1 and showing an operative phase thereof.
Figure 3:
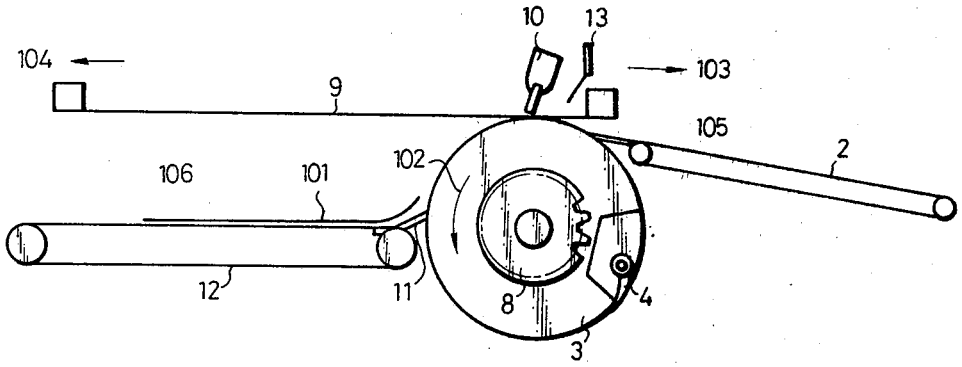
FIG.3 PRIOR ART
FIG. 3 is a schematic view similar to FIG. 2 and showing another operative phase.
Figure 4:
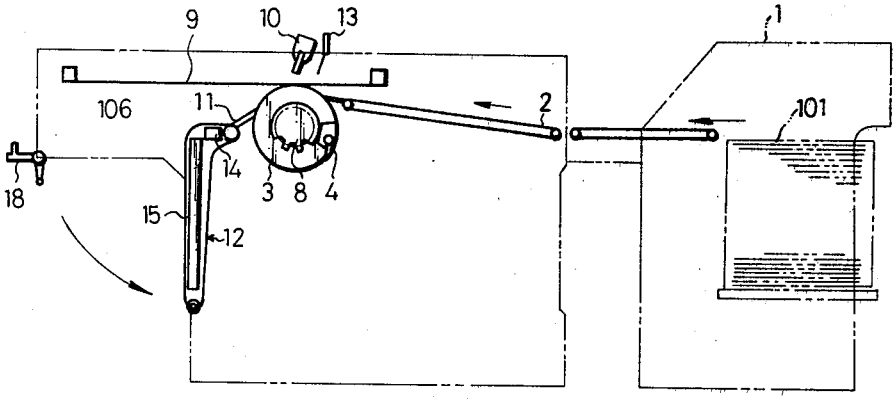
FIG. 4 is a schematic view showing the cylinder-type screen printing machine provided with the paper discharge device of the present invention.
Figure 5:
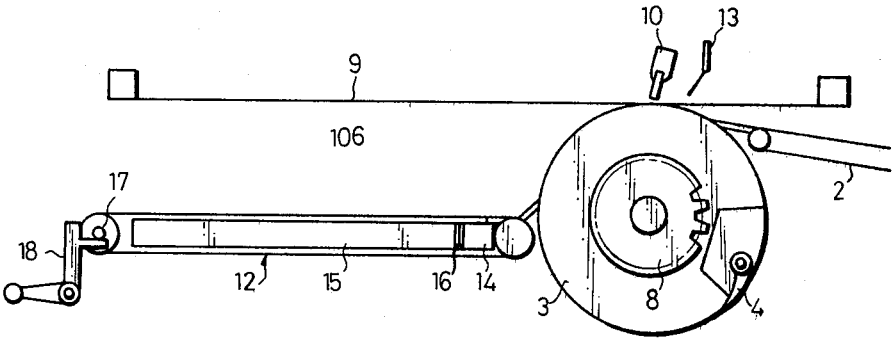
FIG. 5 is a schematic view of the discharge device of FIG. 4 and showing the status of the paper discharge device during printing operation thereof.
Figure 6:
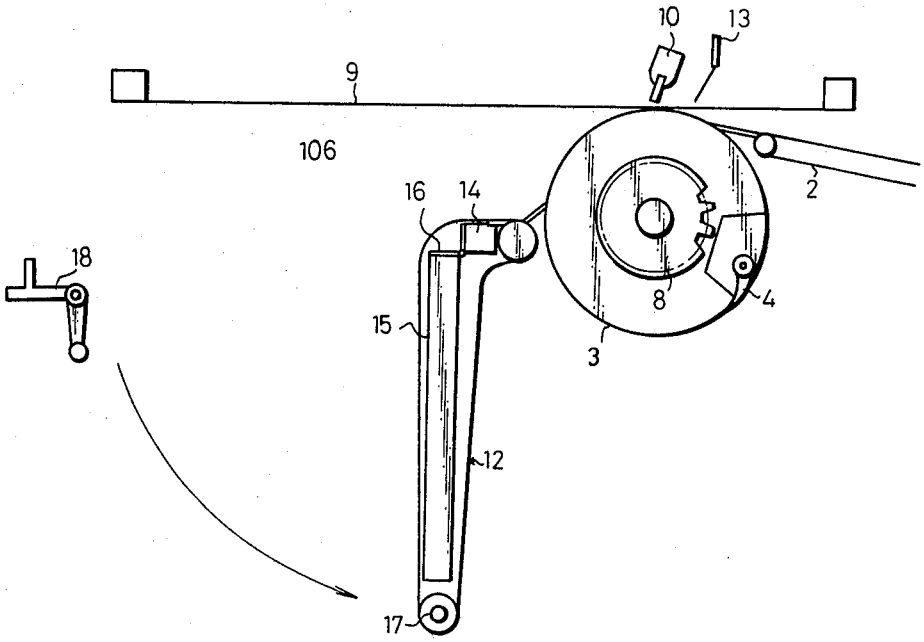
FIG. 6 is a schematic view similar to FIG. 5 but showing the status of the discharge device during screen cleaning operation.

In an embodiment of the invention shown in FIGS. 4 and 5, a paper sheet discharge table 12 has a belt support table divided into a forward belt table 14 and a rear belt table 15 at a position close to the cylinder 3. The forward belt table 14 is connected by a hinge 16 to the rear belt table 15. The end part of the rear belt table 15 has a pin 17 which may rest on a support lever 18 for the paper sheet discharge table 12 during printing operation. When the rear belt table 15 is bent down substantially vertically as shown in FIGS. 4 and 6, a wide space 106 may be provided below the screen 9, so that one may have a manual access to such space below the screen 9 or insert a tool into such space to effect the cleaning of the underside and remove smudges from the surface of the cylinder 3, with resulting improvement in the operating efficiency.

Figure 7:
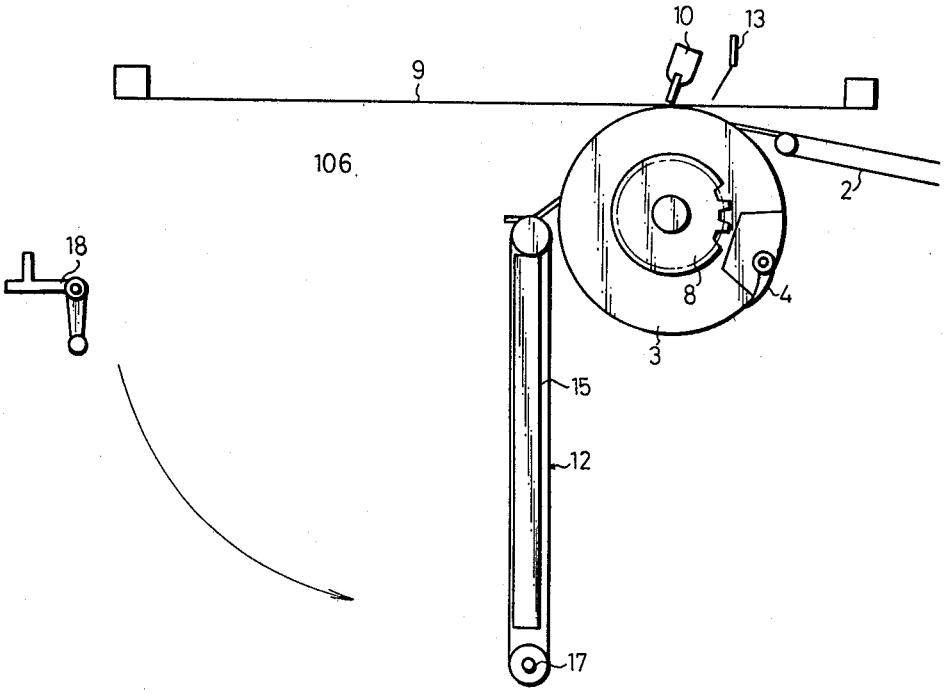
FIG. 7 is a schematic view showing a modified embodiment of the paper discharge device.

According to a modification shown in FIG. 7, the discharge table 12 may not be folded halfway as in the preceding embodiment, but is pivotally mounted at the end towards the cylinder 3 so that the discharge table 12 may be swung down at said end. Alternatively, the discharge table 12 may be lowered while maintaining its horizontal position.

Since various changes can be made without departing from the spirit and scope of the invention, the present invention is not limited in any way to the specific embodiments thereof except as specified in the appended claims.

What is claimed is:

1. A paper sheet discharge device in a cylinder type screen printing machine, said device comprising a cylinder for transferring printing sheets towards a discharge table mounted downstream thereof, a screen mounted on top of said cylinder and adapted to travel back and forth in synchronism with forward and reverse rotation of said cylinder, said screen being pressed from above in synchronism with rearward travel of said screen to effect printing a design on printing sheets supplied between said screen and the cylinder, and means for alternately carrying said paper discharge table in a first operative position for receiving printing sheets from said cylinder or in a second non-operative cleaning position with said second position providing easy access to the underside of said screen so as to allow said screen to be cleaned in its mounted position.

2. The device according to claim 1 wherein said discharge table is mounted at least at the rear portion thereof so that it may be retreated towards below with the forward portion thereof as center.

3. The device according to claim 2 wherein the paper discharge table is devided at a position close to the cylinder into two portions, that is, a forward belt table of a shorter length and a rear belt table of a longer length, and said means for carrying said paper sheet discharge table comprize a hinge for connecting said rear belt table to said forward belt table in a manner to permit said rear belt table to swing down relative to said forward table, and a lever for carrying said paper discharge table, said lever being designed to releasably engage with the rear end of said rear belt table.

4. A paper sheet discharge device for receiving printing sheets in a cylinder type screen printing machine, said device comprising:

a discharge table;

a cylinder for transferring said printing sheets towards said discharge table mounted downstream of said cylinder, said discharge table mounted at the forward portion thereof to said cylinder type screen printing machine and divided at a position close to said cylinder into a forward table portion of a shorter length and a rear table portion of a longer length;

a screen mounted on top of said cylinder and adapted to travel back and forth in synchronism with forward and reverse rotation of said cylinder, said screen being pressed from above in synchronism with forward travel of said screen to effect printing a design on printing sheets supplied between said screen and the cylinder;

means for carrying said paper sheet discharge table including a hinge for connecting said rear table portion to said forward table portion in a manner to permit said rear table portion to swing down relative to said forward table portion into a non-operative cleaning position which provides a space between the rear table portion and said screen so as to allow easy manual access to the underside of said screen to thereby allow said screen to be cleaned in its mounted position; and said means including a lever for latching said rear table portion in an operating position and releasably engaging said rear table portion so as to permit said rear table portion to swing down relative to said forward table portion.

* * * * *